US006065161A

United States Patent [19]

Mateina et al.

[11] Patent Number: 6,065,161

[45] Date of Patent: May 23, 2000

[54] DEVICE FOR PRODUCING A FLOW OF WATER OR A FLOW OF WATER AND AIR

[75] Inventors: Ludger Mateina; Bernd Woeste, both of Ahlen; Roland Beck, Beckum, all of Germany

[73] Assignee: Franz Kaldewei GmbH & Co., Ahlen, Germany

[21] Appl. No.: 09/225,806

[22] Filed: Jan. 5, 1999

[30] Foreign Application Priority Data

Jul. 30, 1998 [DE] Germany ..... 198 34 341

[51] Int. Cl.[7] ..... A61H 33/00

[52] U.S. Cl. ..... 4/541.6; 4/492; 417/407

[58] Field of Search ..... 4/492, 541.1–541.6; 417/405–407; 415/115

[56] References Cited

U.S. PATENT DOCUMENTS

| | | | |
|---|---|---|---|
| 3,220,350 | 11/1965 | White | 415/115 |
| 4,013,384 | 3/1977 | Oikawa | 415/115 |
| 4,832,838 | 5/1989 | Stone | 4/492 |
| 5,056,168 | 10/1991 | Mersmann | 4/541.6 |
| 5,063,620 | 11/1991 | Mersmann | 4/541.6 |
| 5,335,376 | 8/1994 | Kaldewei | 4/541.6 |
| 5,386,598 | 2/1995 | Mersmann | 4/541.4 |
| 5,546,617 | 8/1996 | Sandrin | 4/541.6 |
| 5,779,439 | 7/1998 | Dufour | 415/115 |

FOREIGN PATENT DOCUMENTS

| | | | |
|---|---|---|---|
| 417-338 | 3/1991 | European Pat. Off. | 4/492 |

*Primary Examiner*—Charles R. Eloshway
*Attorney, Agent, or Firm*—Collard & Roe, P.C

[57] ABSTRACT

A device for producing a flow of fluid such as water or air in a whirlpool tub, having a rotatable impeller, which aspirates water from the space of the tub via intake openings, and ejects a jet of water or a jet of water and air into the space of the tub via outlet openings. The device further has a drive means for driving the impeller via a drive shaft. The driving means is arranged on the driving axle of the impeller but behind the impeller as viewed within the tub. In addition, the device further comprises a driving means such as a hydromotor, a pneumatic drive or a mechanical drive, that are driven by at least one central power drive, and can be serviced and repaired from within the whirlpool tub.

4 Claims, 4 Drawing Sheets

IV 26
27
25
16
12
32
21
11
28
29
10
20
19
18

DEVICE FOR PRODUCING A FLOW OF WATER OR A FLOW OF WATER AND AIR

BACKGROUND OF THE INVENTION

1. Field of the Invention

The present invention relates to a device for producing a flow of water or a flow of water and air in a whirlpool tub. This device comprises a rotatable wheel, which pumps in water from the tub via intake openings, and ejects a flow of water or a flow of water and air into the space of the tub via an outlet opening. Furthermore, this device comprises a driving means for driving the wheel via a driving shaft. The driving means is located on the driving axle but behind the wheel as viewed from within the tub.

2. The Prior Art

This type of device is known from German patent specification DE 39 07 552 C2. This patent shows an electric motor used as the driving means. Unfortunately, these electric motors are relatively heavy, as a rule, and increase the installation weight of individual units to be installed. These motors are comprised of the electric motor, a drive shaft, an impeller, and intake and outlet openings. Furthermore, it is very complicated and costly to seal the electric motor effectively against the external space. The motor is sealed so that its function is not impaired by the penetrating water. Moreover, it is quite costly to seal or bond this type of an electric motor.

Thus, the present invention differs from the prior art because it provides a device that comprises a driving means that can be applied in a simple manner.

SUMMARY OF THE INVENTION

In this invention, a hydromotor, a pneumatic drive and a mechanical drive are used as an alternative driving means. All three types of drives are designed in a way that is simpler than an electric motor, and do not have any electric connections. Therefore, in all three driving concepts, there is no need to provide any costly electronic installations, or to seal the driving means.

In a preferred embodiment of the invention, there is at least one central power drive to drive the driving means. The central power drive may be designed in the form of a pump, by which an operating liquid can be pumped to the hydromotor or hydromotors. This pump would be connected with one or more hydromotors via a separate hydrocircuit. In addition, a compressor is provided as the central power drive when pneumatic drives are employed. When a mechanical drive is used, a motor can be provided with a transmission as the central power drive. This transmission can be connected with the individual driving means, which is designed as gears. These gears drive the driving shafts via flexible shafts, belt drives or chain drives. Thus, the device is designed so that the driving means can be serviced, repaired, and dismantled from inside a whirlpool tub.

According to a preferred embodiment of the present invention, the outlet openings are disposed in a pivoted outlet means which may be designed in the form of a bell housing. This type of an outlet permits the user to let water to flow and air to exit from the outlet openings and enter the inside space of the tub in any desired direction.

Thus, one advantage is for the drive shaft and the wheel to have at least one axial bore through which fluid flows. This fluid current exits from the wheel on the tub side. In addition, a current of air can be mixed with the flow of water and aspirated via the intake openings, within the bell-shaped outlet means. In this way, it is possible to produce a flow of water and air simply and effectively. This driving shaft contains an axial bore because the driving shaft of a hydromotor, pneumatic drive or mechanical drive is not as complicated as the driving shaft of an electric motor.

One advantage of the invention is to have the intake openings slope downward in the direction of the inside space of the bathtub, making them self draining. In this case, no residual water can collect in these openings. This assures the hygienic safety of the device.

An object of the invention is to provide a water and air pump for a whirlpool tub that is simple in design.

Another object of the invention is to provide a water and air pump motor that is shielded from water in a bathtub.

Still another object of the invention is to provide a water and air pump motor that is easy to manufacture and simple to install.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
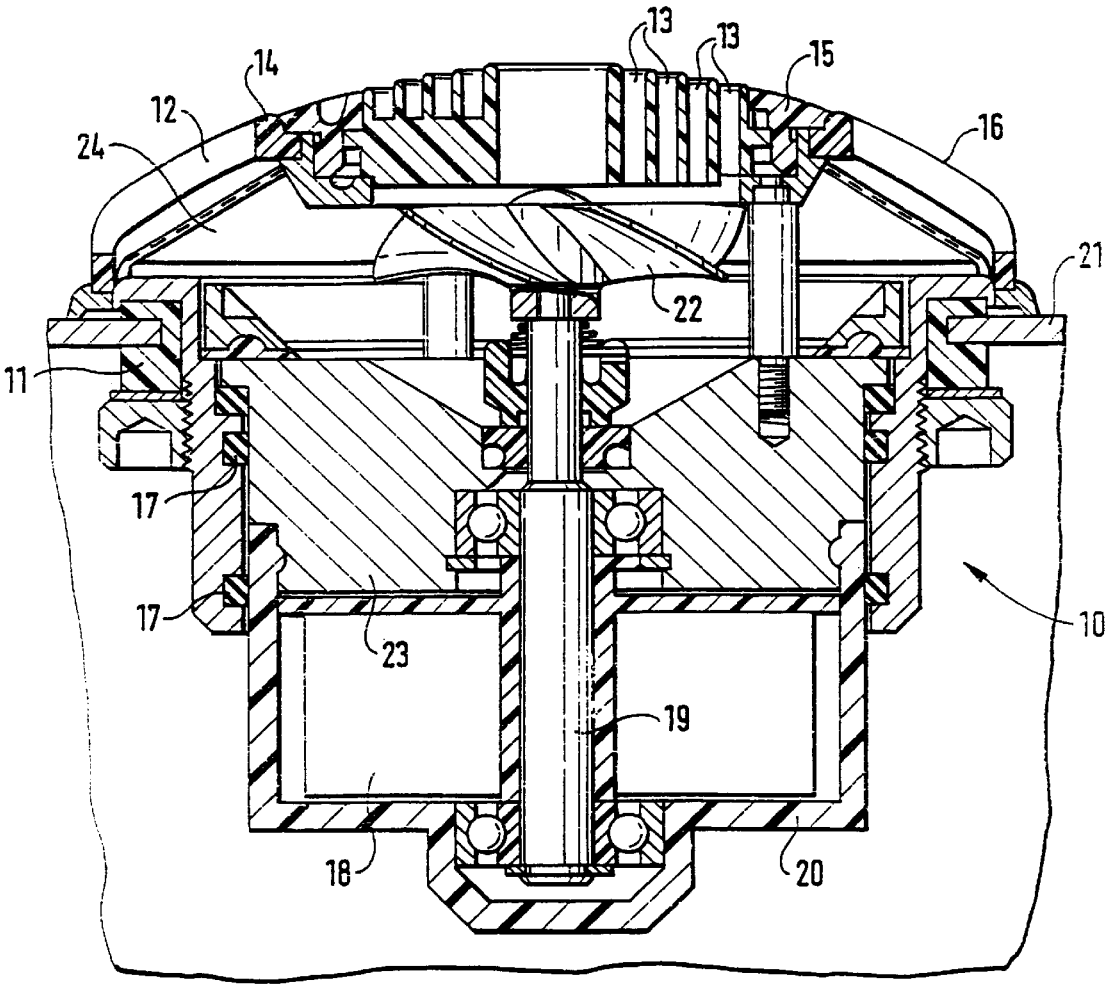
FIG. 1 shows a section through part of a device installed in a whirlpool bathtub and comprising a motor, a wheel and outlet openings.

Turning now in detail to the drawings, FIG. 1 shows part of a device that produces a flow of water or a flow of water and air. This part of the device is installed in a bore in the wall of bathtub 21. A sleeve-like motor receptacle or housing 10 is inserted in the bore of the wall of bathtub 21. This motor receptacle covers the bore in the marginal region with a flange. A sealing ring 11 is installed between motor receptacle 10 and the wall of bathtub 21. This sealing ring or gasket serves to mount motor receptacle 10 tightly in the bore of the wall of bathtub 21.

In the embodiment shown FIG. 1, a hydromotor 18 serves as the driving means for driving a drive shaft 19. A wheel designed in the form of impeller wheel 22 is mounted on the front end of driving shaft 19. Hydromotor 18 is secured on motor shield 23, in which drive shaft 19 is supported in a rotatable and sealed manner. Motor shield 23 is sealed against motor receptacle 10 by means of O-rings 17.

Impeller 22 rotates in a chamber 24, which is covered on the edge of the tub by an intake rosette 16. The edge of intake rosette 16 rests tightly against the wall of bathtub 21. Intake rosette 16 has a ring of intake openings 12 which are designed in the form of radially extending slots. This ring of intake openings 12 extends slightly outside of the circumference of impeller 22.

The central zone of intake rosette 16 is recessed and receives a jet guide with outlet openings 13. The jet guide is secured via a mounting ring 15 in receiving ring 14, on which intake rosette 16 is secured. Receiving ring 14 is attached to motor shield 23, by means of bolts, which are arranged around impeller 22 and extend through chamber 24.

The direction of rotation of hydromotor 18 is selected so that impeller 22 aspirates water via intake openings 12 of intake rosette 16 and ejects such water in the form of a water jet via outlet openings 13 of the jet guide. FIG. 1 also shows a pot 20, which is secured on motor receptacle 10 and covers hydromotor 18 on the outer side of bathtub 21.

Figure 2:
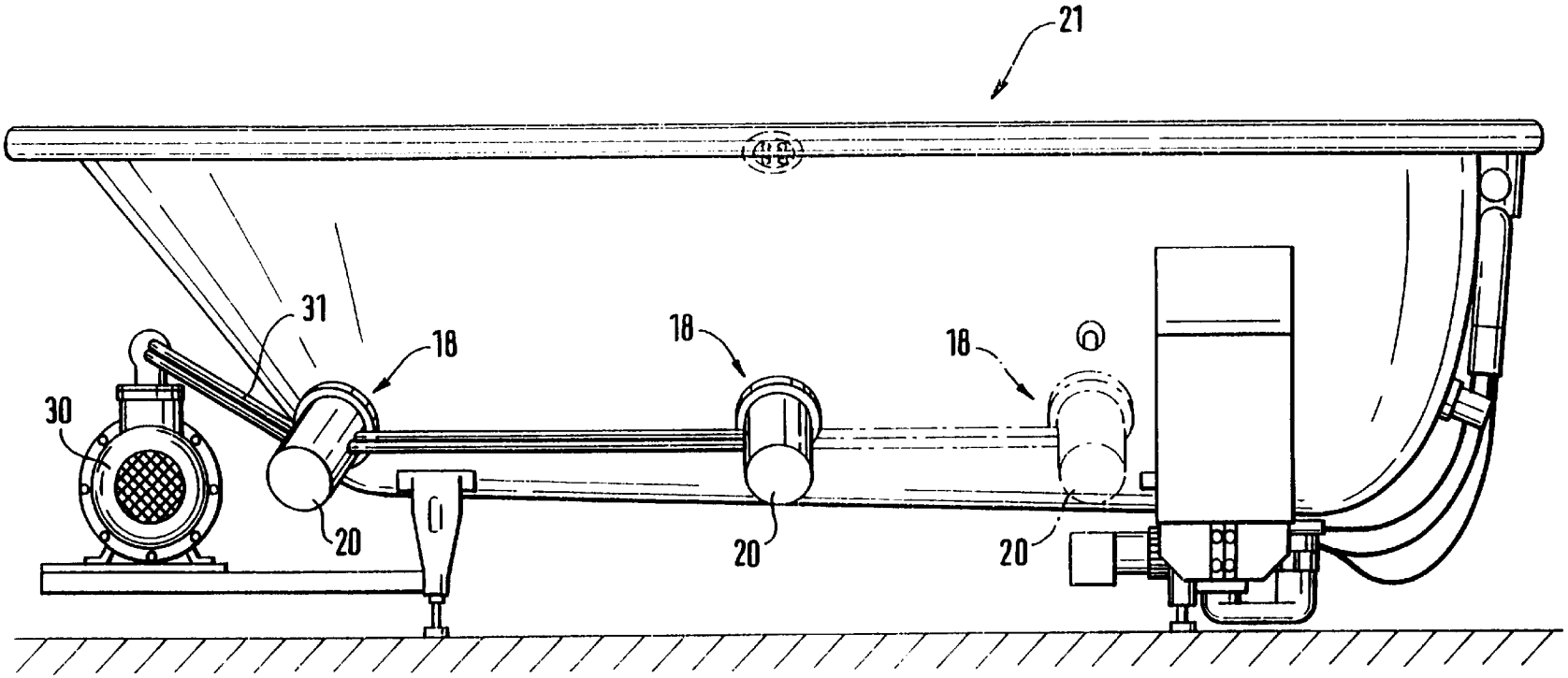
FIG. 2 is a schematic view of the device with a central power drive.

FIG. 2 shows a plurality of pots or cylindrical enclosures 20, wherein each surrounds and encloses a hydromotor 18 on the outer side of a bathtub 21. Furthermore, the device comprises a pump 30 that acts as the central power drive, which connects to the individual hydromotors 18 via conduits-s 31 of a separate hydrocircuit. By pumping an operating liquid, such as water through conduits 31, pump 30 drives individual hydromotors 18.

Instead of using a hydromotor 18, the individual driving shafts 19 can also be driven via pneumatic drives (not shown). In addition, a compressor (air compressor) should be present to serve as the central power drive.

According to another embodiment: of the invention, mechanical drives (not shown) could be provided instead of hydromotors 18 or pneumatic drives. In this case, each could drive one of driving shafts 19. A motor is employed so -hat the central power drive drives each of the driving means. These driving means are designed in the form of gear drives by means of a gear transmission. It would be possible to employ a flexible shaft, a belt drive or a chain drive as the gear drives.

Figure 3:
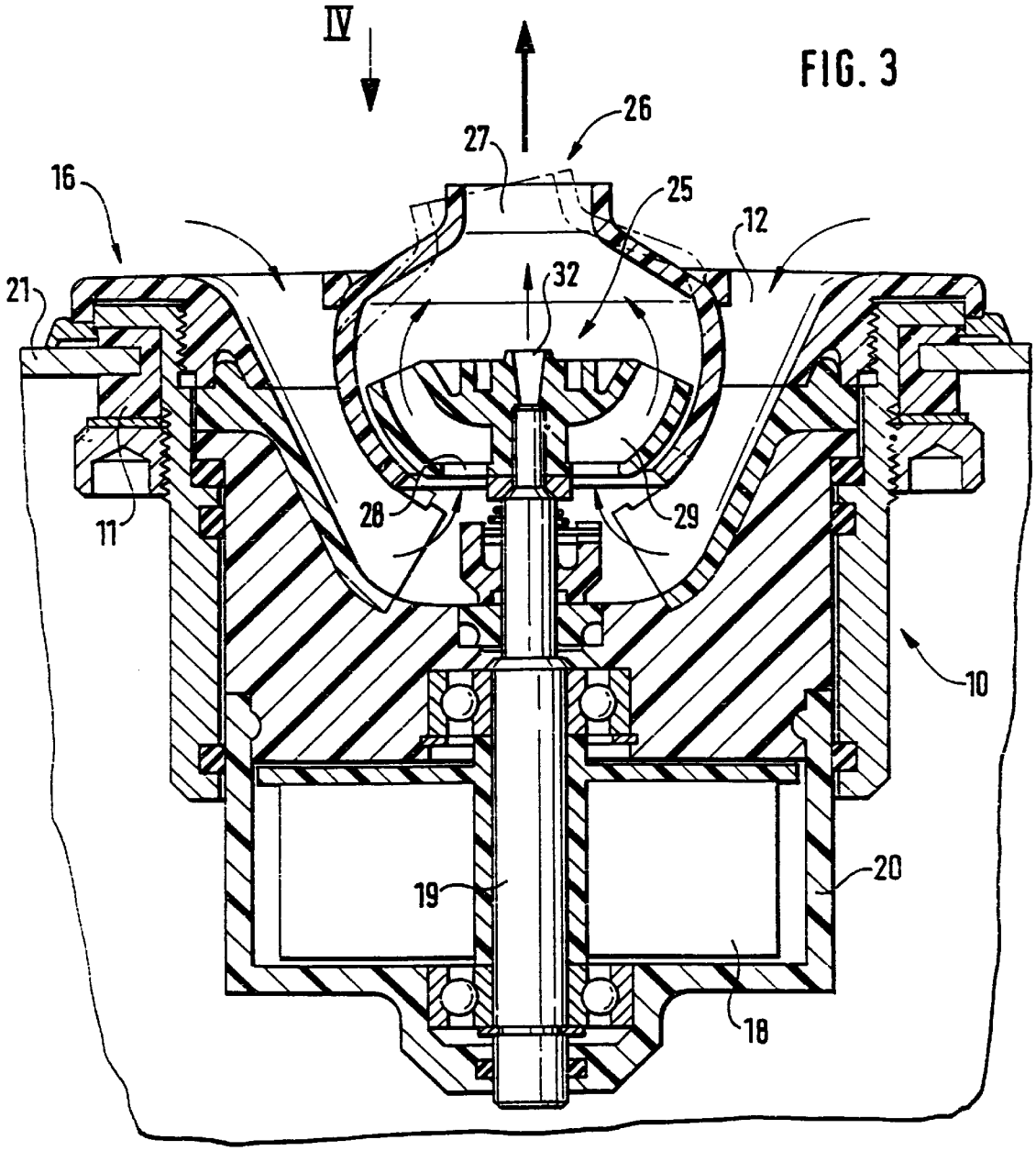
FIG. 3 shows a section through an alternative embodiment of part of a device, which is installed in a whirlpool bathtub.
Figure 4:
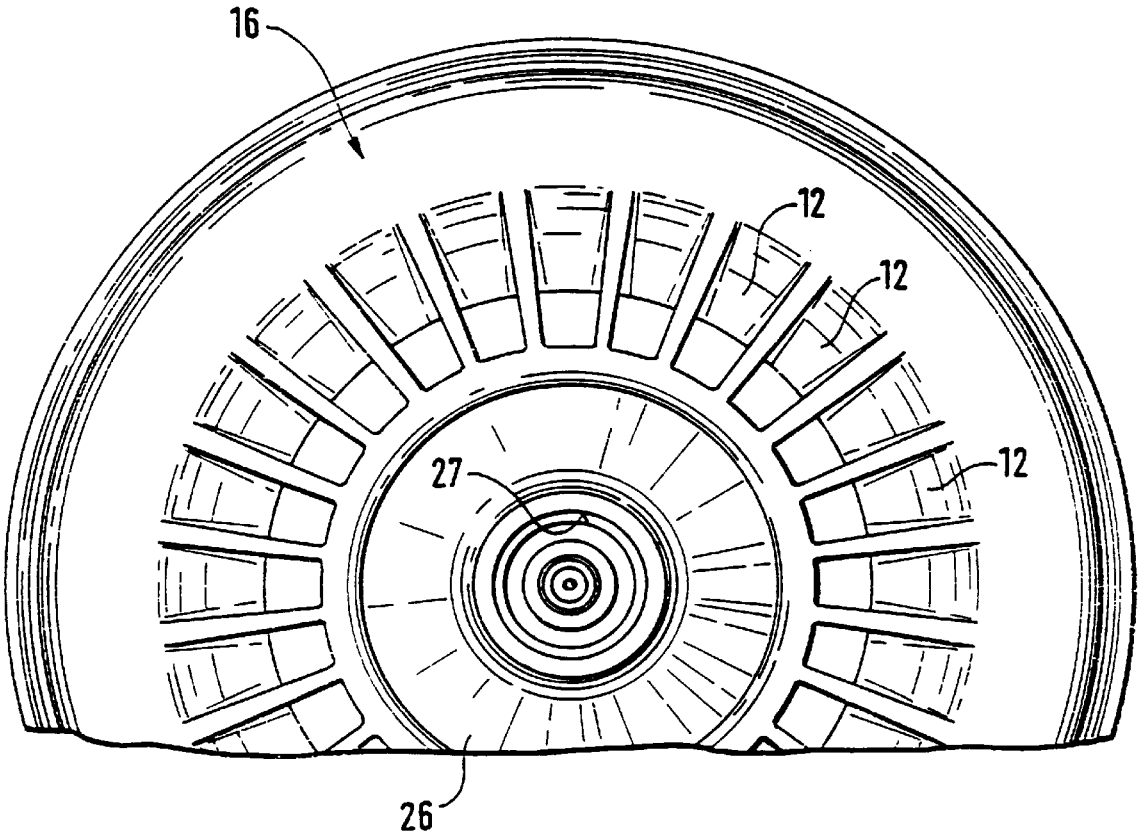
FIG. 4 is a view according to arrow IV in FIG. 3.

Another embodiment of the invention is shown in FIGS. 3 and 4. In FIG. 3, components corresponding with the parts shown in FIG. 1 are denoted by similar reference numerals. Hydromotor 18, as shown in FIG. 3, drives drive shaft 19, which has an impeller 25' mounted on its end on the tub side. Impeller 25' rotates in a bell housing 26, which is pivotably mounted or supported in intake rosette 16'. Bell housing 26 is rotation-symmetrically shaped so that its front outlet opening 27 may point in any desired direction in the interior of bathtub 21. A slightly downwardly swung bell 26 is shown by dashed lines in FIG. 3. Impeller 25' has rear inlet openings 28 and front outlet openings 29 to allow water to be pulled in by way of intake openings 12' of intake rosette 16'.

Furthermore, in the embodiment shown, drive shaft 19 has an axial, through extending bore, which allows for the flow of an air current. This air flow exits from impeller 25' on the tub side via central outlet opening 32. Next, the air current mixes within the water containing bell housing 26. The water air mixture exits from outlet openings 29 of impeller 25', and toward the tub side from outlet opening 27 of bell housing 26.

This type of bell housing 26' with impeller 25' can also be combined with other driving means such as a pneumatic drive, a mechanical drive, or with an electric motor.

Both in the first embodiment according to FIG. 1 and in the second embodiment according to FIG. 3, the intake openings are designed so that when installed, they slope downwardly toward the interior of the bathtub. Therefore, no residual water can accumulate in the intake opening.

Accordingly, while only two embodiments of the present invention have been shown and described, it is to be understood that many changes and modifications may be made thereunto without departing from the spirit and scope of the invention as defined in the appended claims.

What is claimed is:

1. A device for producing a current of water and air for connection to a whirlpool tub (21) comprising:

a) a motor receptacle (10) securable on the tub (21);

b) a driving device (18) connected to said motor receptacle (10) comprising a driving shaft (19), an impeller (25') mounted on the front end of said driving shaft (19) and drive means for driving said drive shaft and impeller;

c) a series of intake openings (12') forming a rosette (16') designed to receive water intake from the tub (21); and d) a bell housing (26) surrounding said impeller (25'), and pivotally mounted to said rosette (16'), said bell housing having a front side with an outlet opening (27), wherein said driving shaft (19) has an axial through bore and said impeller (25') has a corresponding axial bore (32) for feeding a current of air through said driving shaft and said impeller, so that said current of air mixes with a current of water conveyed by said rotating impeller (25') at the outlet of said impeller.

2. The device as claimed in claim 1, wherein said drive means is a hydromotor.

3. The device as claimed in claim 1, further comprising a central power unit for operating said driving device (18).

4. The device as claimed in claim 3, wherein said central power unit comprises:

a) a pump; and b) a hydro circuit connected to said pump.

* * * * *